United States Patent [19]

Arbisi

[11] Patent Number: 4,909,936

[45] Date of Patent: Mar. 20, 1990

[54] WATER AERATING SYSTEM

[75] Inventor: Dominic S. Arbisi, Minnetonka, Minn.

[73] Assignee: Aeras Water Resources, Inc., Minnetonka, Minn.

[21] Appl. No.: 338,460

[22] Filed: Apr. 17, 1989

Related U.S. Application Data

[63] Continuation of Ser. No. 83,453, Aug. 10, 1987, abandoned.

[51] Int. Cl.[4] ..... B01F 3/04

[52] U.S. Cl. ..... 210/220; 210/241; 261/30; 261/93; 261/122

[58] Field of Search ..... 210/170, 219, 220, 241; 261/30, 93, 87, 122, DIG. 75

[56] References Cited

U.S. PATENT DOCUMENTS

| | | | |
|---|---|---|---|
| 4,409,100 | 10/1983 | Rejendrer | 210/219 |
| 4,431,597 | 2/1984 | Cramer et al. | 261/93 |
| 4,581,182 | 4/1986 | Cramer et al. | 261/93 |

*Primary Examiner*—Richard V. Fisher
*Assistant Examiner*—Coreen Y. Lee
*Attorney, Agent, or Firm*—John W. Adams

[57] ABSTRACT

This is a water aerating unit which is particularly adapted for aerating bodies of water adjacent the shoreline and is readily transportable from one location to another. A suitable transporting vehicle is provided such as a tractor having a power take-off and hydraulic system for providing the driving power water for the propeller as well as the air blower mounted on the unit. The unit is supported on a wheeled frame by which the elevation of the lower submerged end thereof may be adjustably varied by a hydraulic system.

6 Claims, 4 Drawing Sheets

WATER AERATING SYSTEM

This application is a continuation of Ser. No. 083,453, filed Aug. 10, 1987, now abandoned.

SUMMARY OF THE INVENTION

This portable aerator mechanism is specifically designed to provide a pond or lake aerating unit which can be quickly and easily moved from one location to another, either in the same body of water or in other bodies of water such as would be necessary with fish and water life raising ponds which are being widely used commercially.

The concept includes a wheeled trailer unit having a rigid longitudinal supporting structure designed to support an impeller drive shaft as well as an air supply tube and blower. The trailer unit is designed to be connected with the power take-off of a truck or tractor and is provided with a trailer hitch to permit transportation from one location to another. The air discharge tube is connected with an air distributor chamber which discharges air through an air distributor outlet into the path of the submerged water impeller with both the impeller and the air supply blower being driven from the power take-off from a truck or tractor transporting vehicle.

Two embodiments of the invention are illustrated as indicated hereafter. The preferred embodiment is illustrated in FIGS. 6, 7, 8 and 9.

DETAILED; DESCRIPTION OF THE TWO EMBODIMENTS

Figure 1:
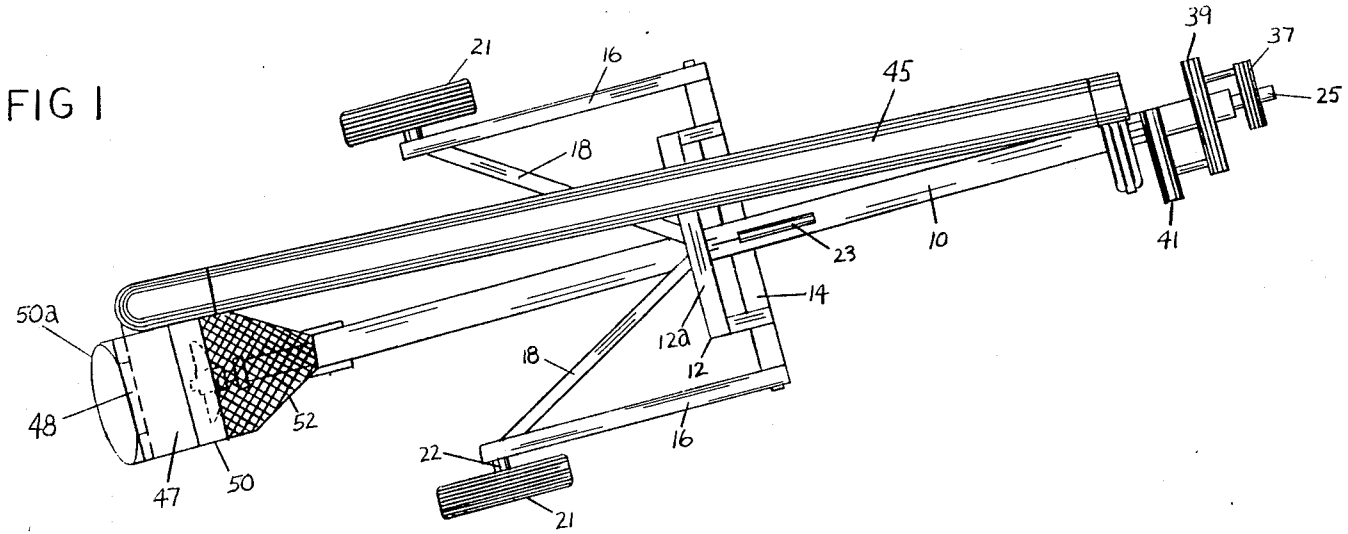
FIG. 1 is a top view of the unit.
Figure 2:
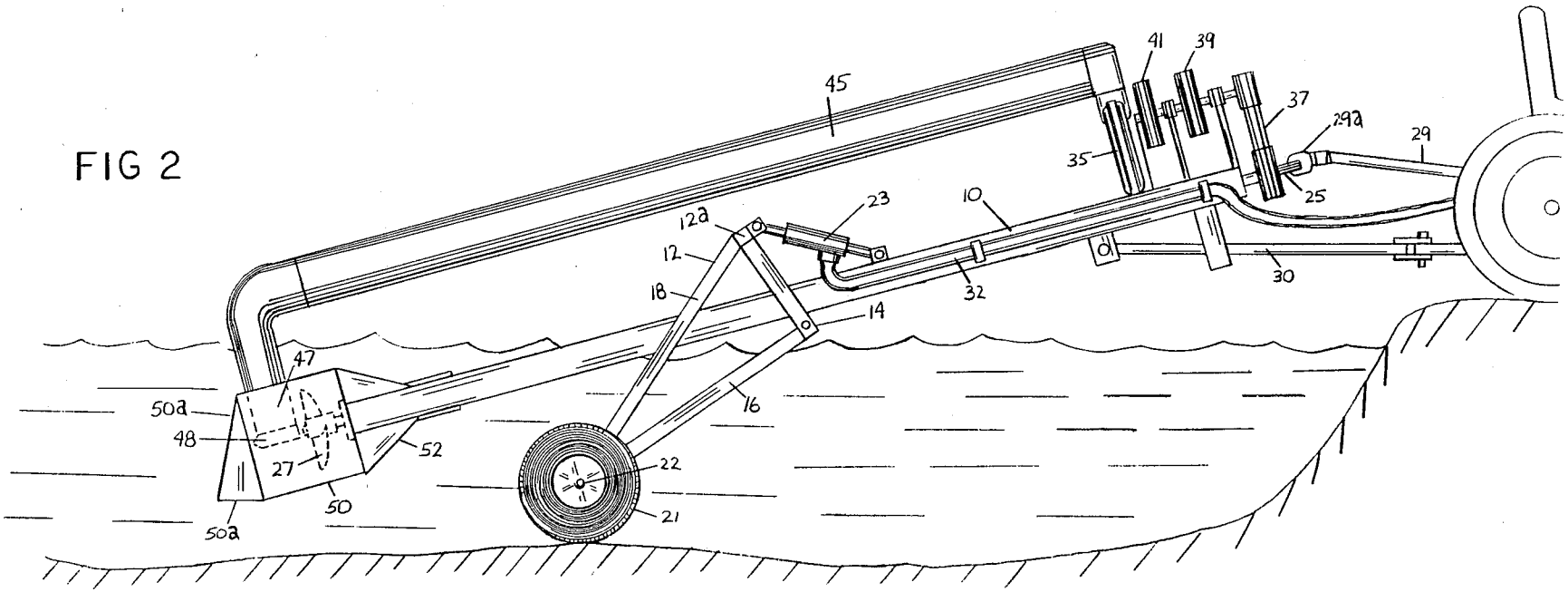
FIG. 2 is a side elevational view thereof.
Figure 3:
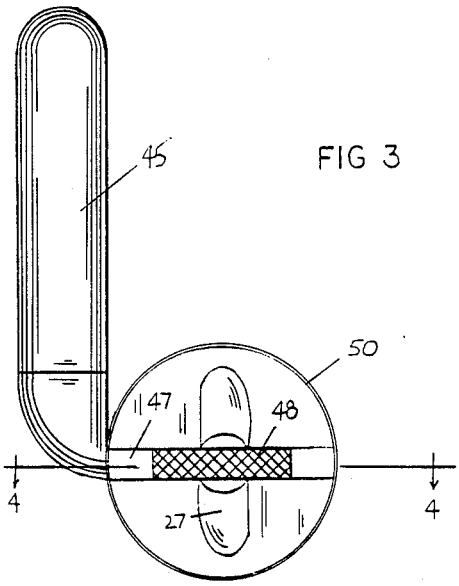
FIG. 3 is a rear view thereof.
Figure 5:
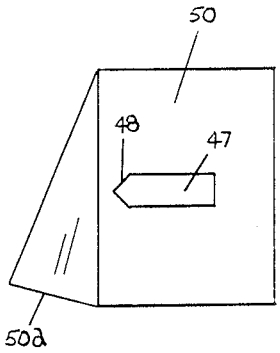
FIG. 5 is a vertical sectional view taken substantially along the line 5—5 of FIG. 3 showing the air distributor head.
Figure 4:
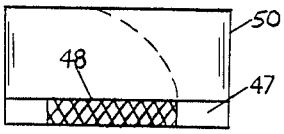
FIG. 4 is a horizontal sectional view taken substantially along the line 4—4 of FIG. 3 showing the air distributor head.

As shown in FIGS. 1–5 of the accompanying drawings, the unit is provided with an elongated longitudinal supporting structure such as the hollow rigid square tubular member 10. A wheeled frame unit is provided which includes a transverse box frame unit 12 pivotally mounted on the member 10 as by the transverse support shaft 14 which is secured to the member 10. A pair of supporting arms 16 have their rear ends connected to the shaft 14 for pivotal movement thereon. A pair of bracing struts 18 connect the lower ends of the supporting arms 16 to the upper cross bar 12*a* of the box frame unit 12. A pair of wheels 21 are journaled on the suitable stub axles 22 connected at the lower ends of the supporting arms 16. The elevation of the longitudinal supporting member 10 can be adjustable varied by a double acting hydraulic cylinder 23 which is connected at its upper end to the cross bar 16*a* and at its lower end to the top of the member 10 as best shown in FIG. 1.

The hollow longitudinal supporting member 10 is provided with suitable bearings (not shown) which support a longitudinal impeller drive shaft 25 which extends the full length thereof. An impeller shown in the form of a propeller 27 is connected to the submerged rear end of the shaft 25. A transporting vehicle, such as the tractor T, having a power take-off connection provides rotary power to shaft 25 through a power take-off shaft 29 and universal joint 29*a*, as shown. A draw bar 30 connects the forward end of the rigid supplying member to the tractor T. A pair of hydraulic lines 23*a* are provided for supplying hydraulic fluid under pressure to actuate the conventional double acting hydraulic cylinder 23.

An air blower 35 is mounted on the upper end of the longitudinal supporting member 10 and in the form shown is driven at a speed of approximately 10 times the r.p.m. of the power take-off drive shaft 25. Three stages of belt and pulley drives are provided to produce the desired speed increase from the power take-off shaft 25. These are respectively designated by the numerals 37, 39 and 41 as indicated in the drawings. An air supply tube 45 is connected to the discharge of the air blower 35 and is mounted on the longitudinal supporting member 10 to deliver air from the blower to a hollow air distributor head 47 mounted at the lower end thereof. A tubular shroud or housing 50 surrounds the propeller 27 and the air distributor head 47 disposed down stream from the propeller and confines the water discharged from the propeller during the mixing of the air discharged from the air distributor chamber 47 through an air distributor outlet 48, which is specifically designed to produce small air bubbles which are exchanged immediately upon discharge into the stream of water from the propeller and outwardly into the pond by the flowing air and water mixture to provide substantial aeration of the pond water. The forward end of the shroud or housing 50 has an intake screen 52 connected therewith through which water is drawn by the propeller 27, and the stream of air and water mixture is discharged through the rear end of the housing 50 into the pond water. It will be noted that the lower rear end of the housing 50 is provided with an extension 50*a* designed to provide a supporting skid at the lower rear end of the unit when necessary.

The preferred embodiment is specifically illustrated in FIGS. 6–9. This embodiment includes a propeller housing 60 surrounding a propeller 61 which is driven by shaft 62. The propeller 61 and shaft 62 are generally similar to the propeller 27 and shaft 25 shown in the embodiment of the invention illustrated in FIGS. 1 through 5. The shaft 62 is enclosed within a supporting member 62*a* which is similar to supporting member 10. The housing 60 is generally cylindrical and defines a water confining passage extending rearwardly from the propeller 61. The intake end of the housing 60 is designated by the reference character 60a and the discharge end thereof is designated by the reference character 60*b*.

The forward portion of the propeller housing is enclosed by a wire mesh screen 63 to prevent large solid objects from being drawn into the housing during operation.

The housing 60 extends rearwardly from the propeller and has a flow accelerating member 70 fixed in spaced relation within the housing 60 to define an annular accelerated flow passage 72 between the inside surface of the housing 60 and the outer surface of the flow accelerating member 70.

An air supply conduit 75 delivers air from a blower 76 similar to blower 35 in the form of the invention illustrated in FIGS. 1–5. The conduit 75 delivers the pressurized air flow into an air distribution housing 80 which surrounds the housing 60.

The housing 80 is spaced outwardly from housing 60 to define an annular air flow passage there between. An air discharge opening is provided around a lower circumfirential portion of the housing 60 and an air distributor screen 85 is provided through which air is discharged under pressure into the annular flow passage 72 for mixing the finely divided air with the accelerated water flowing through the passage. The air distributor screen 85 extends around approximately 120 degrees of the circumference of housing 60 and the screen has openings not to exceed a size of 2 mm. to insure that the discharged air is divided into small bubbles for maximum mixing with high velocity water flowing through the passage 72.

Figure 6:
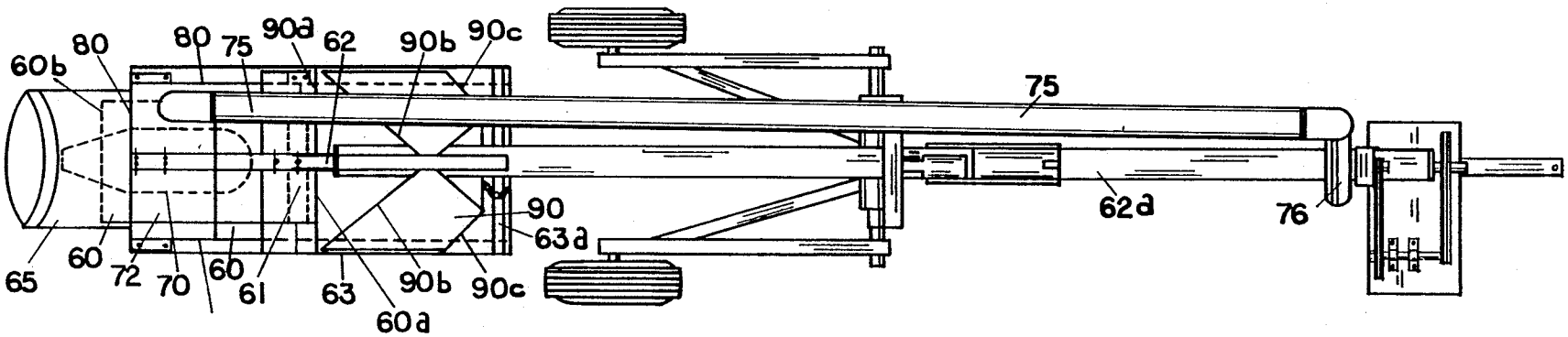
FIG. 6 is a top plan view of a modified form of the invention.
Figure 7:
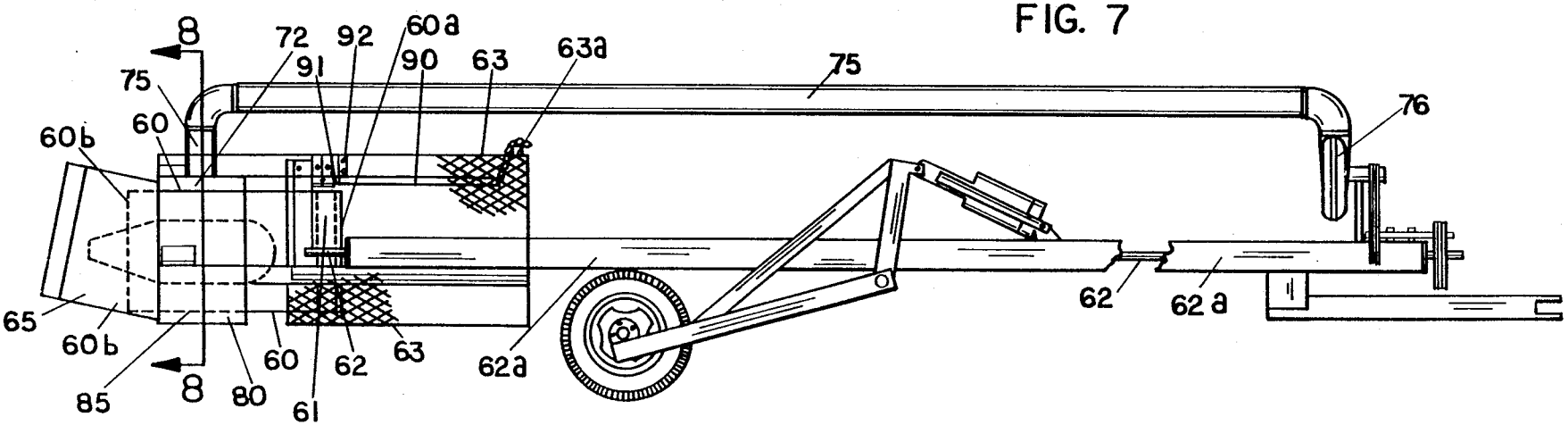
FIG. 7 is a side elevation view thereof.
Figure 8:
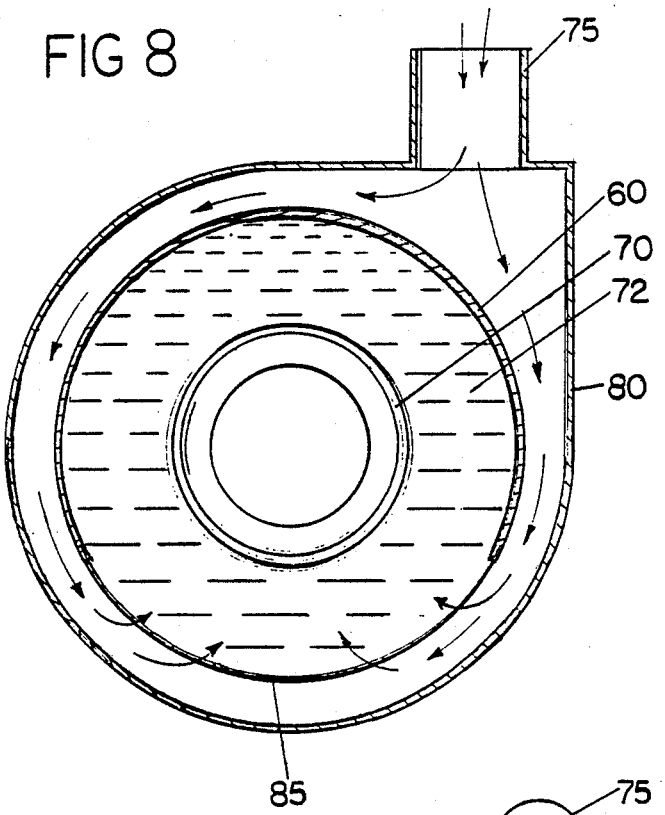
FIG. 8 is a vertical sectional view taken substantially along the line 8—8 of FIG. 7.
Figure 9:
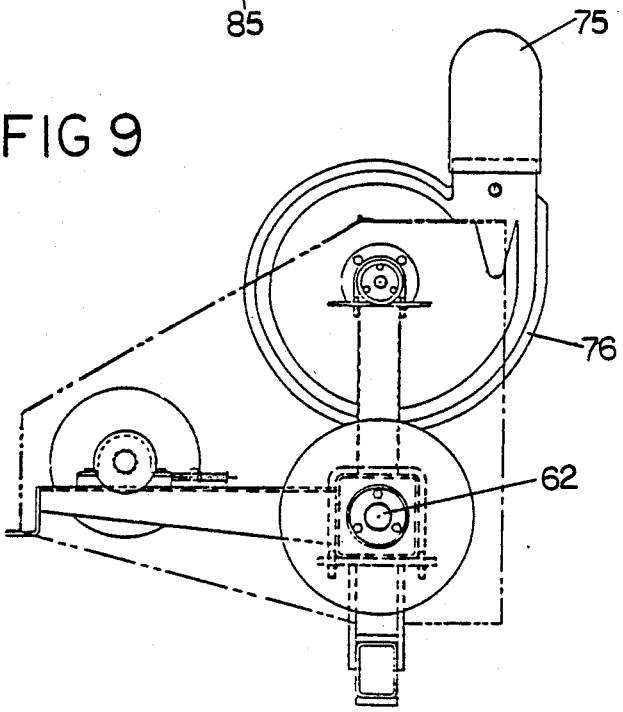
FIG. 9 is a front elevational view of the modified form of the invention.

An anti-vortex shield member 90 is pivotally mounted on a pair of transverse pivot support rods 91 which are securely anchored on suitable mounting brackets 92 positioned within the upper portion of the area defined within the protective cage defined by screen member 63. This defined area in the form shown is generally rectangular in cross-sectional shape to permit the vortex shield number 90 to be raised and lowered on its transverse pivot support rods 91 as an axis. The leading edge **90*a* of the shield member 90 is adjustable supported within the protected area defined with the screen 63 to permit the angle of the shield member to be adjusted and thus prevent the propeller 61 from producing a vortex at the intake end 60*a* of the housing 60. This vortex action occurs principally when the unit is close to the surface of the pond being aerated (usually within 2–3 inches below the surface). It has been found that the vortex shield member 90 operates most efficiently, when needed, when the plane generally defined thereby approaches a substantially parallel orientation to the surface of the water. When the unit is being operated more than 5–6 inches below the water surface, the problem of the propeller producing an intake vortex has a lower probability of existing. The adjustment of the angle of the vortex shield member 90 may be produced by a number of different mechanisms, but in the form illustrated, the leading edge is provided with a supporting link chain which can be adjustably connected at its upper end to a slotted cross member 63*a* mounted above the screen 63. The specific anti-vortex shield member 90 illustrated herein has a pair of diagonally oriented stiffening bends 90*b* extending forwardly from the rear corners of the shield member 90 as best shown in FIG. 6. Also the forward edge of the member 90 may be beveled at the corners as illustrated at 90*c* in FIG. 6** to provide stability during operation.

The air from blower 76 through conduit 75 and distribution housing 80 is supplied at between 500 and 1500 cu. ft./min. and is sheared off by the high velocity water flowing at between 8 and 15 ft./sec. around the accelerating member 70 and through the annular mixing chamber 72. The trailing end portion of the accelerating member 70 is tapered so that the area of the annular mixing chamber 72 increases as the water flows therethrough to the inclined discharge nozzle and skid member 65 which extends rearwardly from the discharge end **60*b* of the housing 60. The flow of water and air is increased as the depth of the submerged nozzle 65** is increased by the operator.

The wheeled frame unit as well as the power take-off and trailer hitch mechanisms are generally similar to the construction described in connection with the form of the invention illustrated in FIGS. 1–5.

What is claimed is:

1. A readily transportable wheeled aerator unit comprising, a set of wheels for supporting the unit, an elongated frame structure rotatably mounted on said wheels for adjustable movement on an axis which is disposed in transverse relation to the frame structure, a trailer hitch connected at one end of the frame structure to permit a transporting vehicle to be attached thereto, an elongated power shaft mounted on said supporting frame structure with the upper end being connected to a suitable rotary power source, a propeller connected to the other end of the shaft for discharging a flow of water outwardly therefrom, a screened water intake connected with the propeller to permit water to be supplied to the propeller through a screen, a blower mounted on the upper end of said supporting frame and having a driving connection with the rotary power source to provide a source of flowing air under pressure, a delivery tube receiving the air being discharged from said blower, a screened air distributor head connected with the lower end of the delivery tube and having openings therein disposed in the flow of water discharged from said propeller.

said screened water intake includes a protective cage, a vortex shield member mounted in the upper portion of said cage and positioned in space relation above the propeller to prevent a vortex from developing at the intake of the propeller.

2. The structure set forth in claim 1 wherein the anti-vortex shield member constitutes a hinged plate member disposed above the water intake.

3. A water aerating unit comprising, a water driving propeller, an intermediate water confining flow housing having a forward inlet end and a rear outlet end, the forward end surrounding the propeller to confine the discharge flow from the propeller within the housing, an inner central flow accelerating member mounted within said water flow housing positioned down stream from said propeller and spaced from the inside wall surface of said housing to define a generally annular water accelerating and air mixing passage within said housing, an outer air distributing housing surrounding a substantial length of the water flow housing downstream from the propeller and defining an annular air flow passage between said two housings and provided with a screened air discharge outlet through the water flow housing extending around a substantial portion of the circumference thereof, and means supplying a substantial volume of flowing air under pressure through the screened air flow passage into the annular path of water flowing through the annular accelerating passage to confine the flowing water and air and discharge the combined water and concentrated air mixture into the body of water being aerated.

4. The structure set forth in claim 3 wherein said air distribution outlet extends around approximately 120 degrees of the circumference of the water flow housing.

5. The structure set forth in claim 4 and said air discharge outlet being formed in the lower portion of the water flow housing.

6. The structure set forth in claim 3 and said air discharge outlet being formed in the lower portion of the water flow housing.

* * * * *

UNITED STATES PATENT AND TRADEMARK OFFICE

CERTIFICATE OF CORRECTION

PATENT NO. : 4,909,936

DATED : March 20, 1990

INVENTOR(S) : Dominic S. Arbisi

It is certified that error appears in the above-identified patent and that said Letters Patent is hereby corrected as shown below:

On the title page, Item [75] should read--

Dominic S. Arbisi; Roger E. Mitchell;

Stanley H. Wydella, all of Minnesota--

Signed and Sealed this

Twenty-third Day of April, 1991

*Attest:*

*Attesting Officer*

HARRY F. MANBECK, JR.

*Commissioner of Patents and Trademarks*